US007908890B2

(12) United States Patent
Lonati et al.

(10) Patent No.: US 7,908,890 B2
(45) Date of Patent: Mar. 22, 2011

(54) NEEDLE FOR TRANSFERRING STITCHES THEREFROM TO ADJACENT NEEDLES FOR HOSIERY KNITTING MACHINES OR THE LIKE

(75) Inventors: Ettore Lonati, Botticino (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 492 days.

(21) Appl. No.: 11/922,084

(22) PCT Filed: Nov. 18, 2005

(86) PCT No.: PCT/EP2005/012393

§ 371 (c)(1),
(2), (4) Date: Dec. 13, 2007

(87) PCT Pub. No.: WO2007/057041

PCT Pub. Date: May 24, 2007

(65) Prior Publication Data

US 2010/0043498 A1 Feb. 25, 2010

(51) Int. Cl.
*D04B 35/02* (2006.01)

(52) U.S. Cl. ..... 66/123

(58) Field of Classification Search ..... 66/60 R, 66/116, 119–123, 95, 96 R, 64
See application file for complete search history.

(56) References Cited

U.S. PATENT DOCUMENTS

| | | | | | |
|---|---|---|---|---|---|
| 885,150 | A * | 4/1908 | Foster | 66/24 |
| 2,146,079 | A * | 2/1939 | Kunzmann | 66/95 |
| 2,667,770 | A * | 2/1954 | Sirmay | 66/95 |
| 2,997,865 | A * | 8/1961 | Philip | 66/24 |
| 4,580,419 | A * | 4/1986 | Vincoli | 66/123 |
| 4,612,786 | A * | 9/1986 | Perotti | 66/121 |
| 4,646,542 | A * | 3/1987 | Tenconi | 66/24 |
| 6,085,554 | A | 7/2000 | Apollonio | |
| 6,298,693 | B1 * | 10/2001 | Schaffer | 66/123 |
| 6,807,831 | B2 * | 10/2004 | Roth | 66/123 |
| 2008/0034806 | A1 * | 2/2008 | Wang | 66/121 |

FOREIGN PATENT DOCUMENTS

WO WO 2007057041 A1 * 5/2007

* cited by examiner

*Primary Examiner* — Danny Worrell
(74) *Attorney, Agent, or Firm* — Modiano & Associati; Daniel O'Byrne; Albert Josif

(57) ABSTRACT

A needle for transferring stitches therefrom to adjacent needles for hosiery knitting machines comprises a shank, a head, arranged at a longitudinal end, or upper end, of the shank, and a latch which is pivoted to the shank proximate to the head, about a pivoting axis which is substantially perpendicular to the longitudinal axis of the shank and can rotate about the pivoting axis in order to open or close the head. The needle comprises at least one elastically flexible lamina, which is associated with the shank and forms, on the two opposite sides of the shank, below the latch, two receptacles, one for each side of the shank. The head of an adjacent needle can be inserted in each of the receptacles, in order to transfer the loop of knitting, from the needle being considered to the adjacent needle.

14 Claims, 6 Drawing Sheets

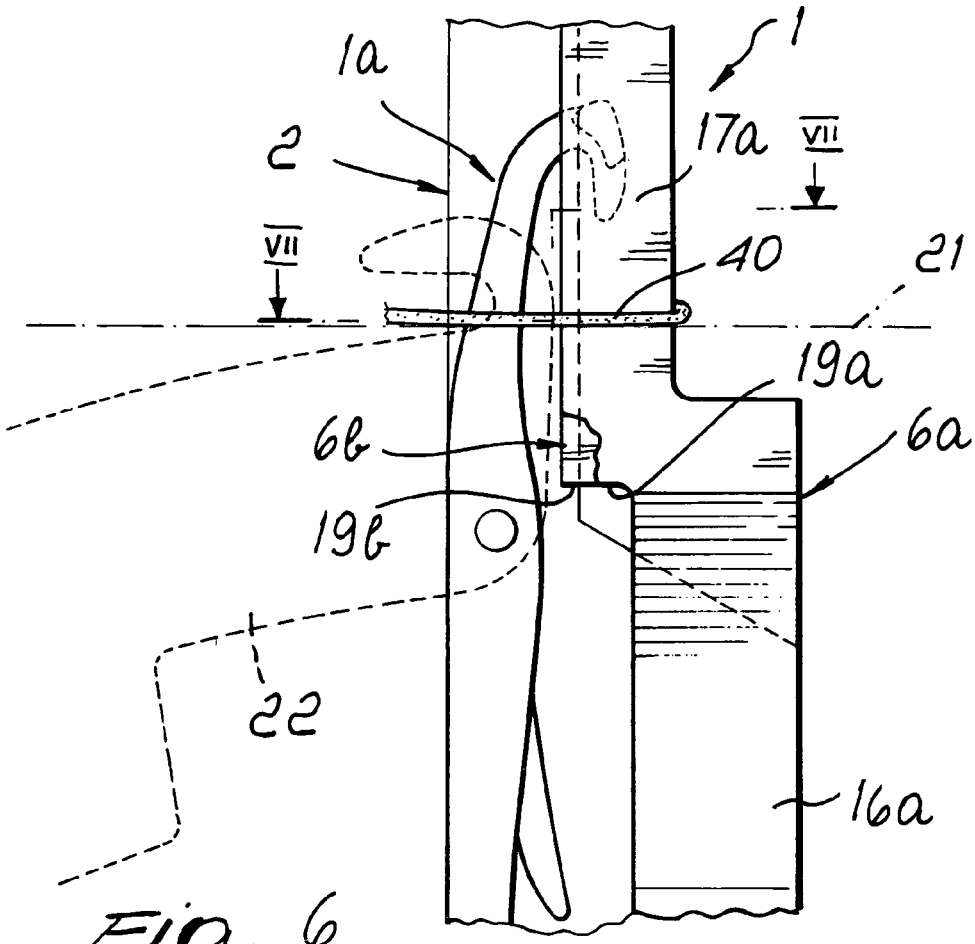
Fig. 6
Fig. 7
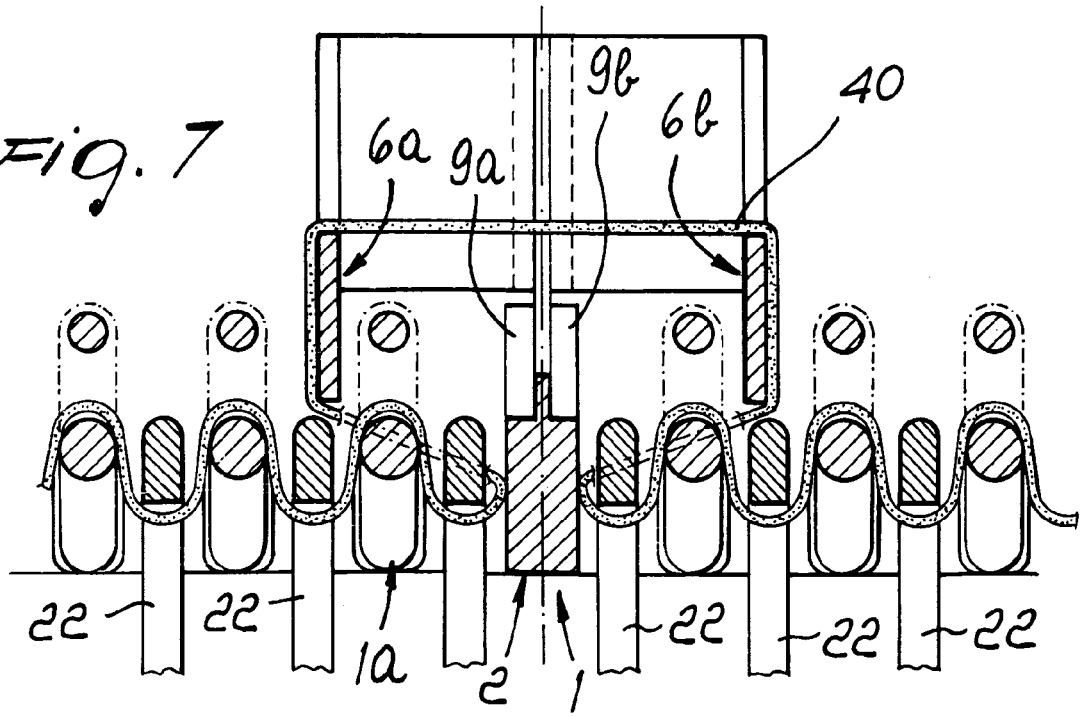

NEEDLE FOR TRANSFERRING STITCHES THEREFROM TO ADJACENT NEEDLES FOR HOSIERY KNITTING MACHINES OR THE LIKE

TECHNICAL FIELD

The present invention relates to a needle for transferring stitches from the needle itself to adjacent needles for hosiery knitting machines or the like.

BACKGROUND ART

In the field of knitting machines or hosiery-making machines, needles are known which are provided in order to allow to transfer a stitch from one needle to an adjacent needle.

One of such needles is disclosed in International Publication WO-02/070799. Said needle has, along its shank, a contoured tab which extends laterally with respect to the shank of the needle and forms, on one side of the needle, a receptacle which can be crossed by the head of another needle arranged laterally to the needle being considered. When a needle of this kind is mounted on the knitting machine or hosiery-making machine, said receptacle is aligned with the adjacent needle. The needle being considered, or transferring needle, in a certain step of the knitting of an item is moved so that the loop of knitting or stitch, which is arranged on its shank, is arranged at this receptacle. The adjacent needle, or receiving needle, is then actuated so as to pass through the receptacle, crossing completely the loop of knitting with its head. The transferring needle and the receiving needle are then actuated so that the transferring needle releases the loop of knitting, which remains attached to the head of the receiving needle.

By means of this type of needle and by means of the method disclosed in International Publication WO-02/070799, to which reference is made for the sake of completeness, it is possible to transfer stitches from one needle to an adjacent needle in order to obtain particular patterns, in particular to obtain open-work effects.

This type of needle, due to the fact that it has a receptacle on a single side, allows to transfer the stitch only to one of the two needles which, in the machine, are arranged laterally to the transferring needle, i.e., to the needle that is aligned with the receptacle of the transferring needle.

The possibility to transfer the stitch only in one direction is not devoid from drawbacks.

By transferring the stitch only in one direction with plain jersey knitting, the knitting in fact tends to rotate in the direction of the transferred stitch. This tendency can be compensated partially by using yarns with specific twists, which however are difficult to obtain.

Moreover, the possibility to transfer the stitches only on one side of the needle constitutes a limitation to the patterns that can be produced.

Other methods which instead allow to transfer the stitch in one direction or the other, depending on the knitting requirements, are known in knitting machines and hosiery-making machines.

In two-bed rectilinear knitting machines, for example, the transfer of the stitch from one needle to the adjacent needle can be performed by transferring the stitch from a needle of one bed to a needle of the other bed, moving the carriage to the end of its stroke, then moving one bed with respect to the other, again transferring the stitch onto the required needle of the bed from which it had been transferred earlier, then returning the carriage to the end of its stroke, thus returning the displaced bed to the working position, and finally resuming knitting. This operation is rather laborious, entails high mechanical precision in performing the movements of the beds, and requires, for its execution, times which penalize substantially the productivity of the machine.

In two-bed circular knitting machines, the procedure is similar to the one used in rectilinear machines, since the stitch to be transferred is passed from a needle of one bed to a needle of the other bed and is then transferred again to a needle of the bed from which it had been previously transferred after adequately displacing one bed with respect to the other. In this case, in order to displace one bed with respect to the other it is necessary to deactivate the feeds of the machine which must then be reactivated in order to resume knitting. This technique suffers substantially the same problems mentioned above with reference to the method for transferring the stitch on rectilinear machines.

In circular hosiery knitting machines, stitch transfer can be performed by means of two punches arranged laterally, one for each side of the needle, and capable of removing the stitch from the needle, transferring it onto the adjacent needle.

Again in circular hosiery knitting machines, stitch transfer can be performed also by using the hooks of the dial, which lies above the needle cylinder of the machine, as if they were needles of another bed. In both of these cases, the use of elements which are external to the needle limits the gauge that can be reached. Currently, the gauge that can be reached on circular hosiery knitting machines capable of transferring the stitch from one needle to an adjacent needle is 18 n.p.i. (needles per inch).

DISCLOSURE OF THE INVENTION

The aim of the present invention is to solve the problems described above by providing a needle which allows to transfer the stitch from the needle itself to one of the two adjacent needles, i.e., in either direction, without requiring the intervention of elements other than the needle that transfers the stitch and the needle that receives the stitch.

Within this aim, an object of the invention is to provide a needle which, while offering the possibility to transfer the stitch to one or the other of the two adjacent needles, can have a reduced thickness, so as to allow its use on fine-gauge machines (greater than 18 n.p.i.).

Another object of the invention is to provide a needle which allows to perform various known types of pattern and also allows to develop new patterns.

Another object of the invention is to provide a needle which can be used advantageously both on circular machines and on rectilinear machines, both of the single-bed and of the two-bed types.

This aim and these and other objects, which will become better apparent hereinafter, are achieved by a needle for transferring stitches from the needle itself to adjacent needles for hosiery knitting machines or the like, which comprises a shank, a head arranged at a longitudinal end, or upper end, of said shank, and a latch which is pivoted to said shank proximate to said head, about a pivoting axis which is substantially perpendicular to the longitudinal axis of said shank and can rotate about said pivoting axis in order to open or close said head, characterized in that it comprises at least one elastically flexible lamina which is associated with said shank and forms, on the two opposite sides of said shank, below said latch, two receptacles, one for each side of said shank, in each of which it is possible to insert the head of an adjacent needle in order to transfer the loop of knitting, carried by said shank and arranged at said receptacles, from the needle to said adjacent needle.

BRIEF DESCRIPTION OF THE DRAWINGS

Further characteristics and advantages of the invention will become better apparent from the description of a preferred but not exclusive embodiment of the needle according to the invention, illustrated by way of non-limiting example in the accompanying drawings, wherein:

FIG. 6 is a side elevation view of a needle according to the invention and of an adjacent needle, which also illustrates part of the machine on which they are mounted, during transfer of the stitch from the needle to the adjacent needle;

FIG. 7 is a sectional view of FIG. 6, taken along the line VII-VII;

FIGS. 8*a*, 8*b* to 10*a*, 10*b* illustrate three moments of the transfer of the stitch from a needle according to the invention to an adjacent needle, shown respectively in a front elevation view in FIGS. 8*a*, 9*a* and 10*a* and in a side elevation view in FIGS. 8*b*, 9*b*, 10*b*.

WAYS OF CARRYING OUT THE INVENTION

Figure 1:
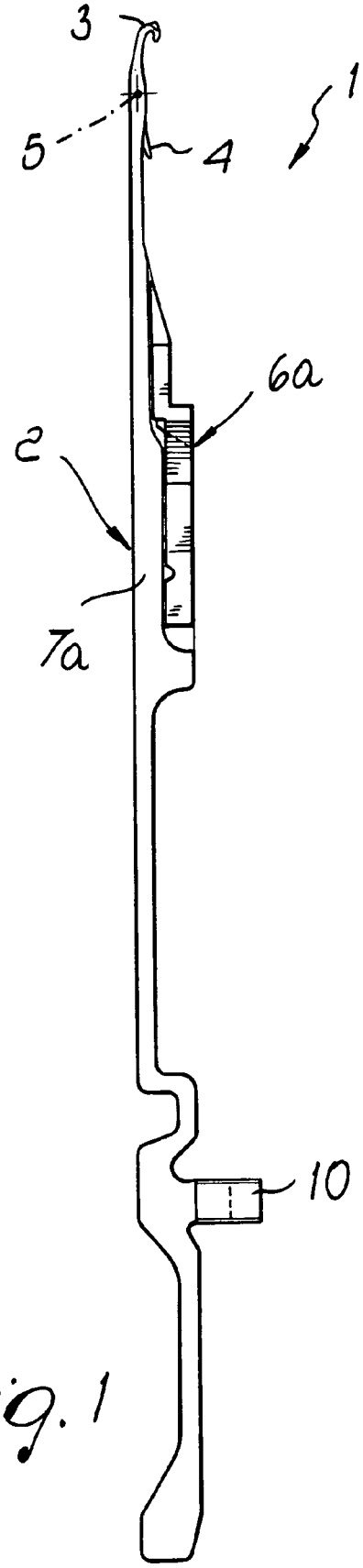
FIG. 1 is a side elevation view of the needle according to the invention.
Figure 2:
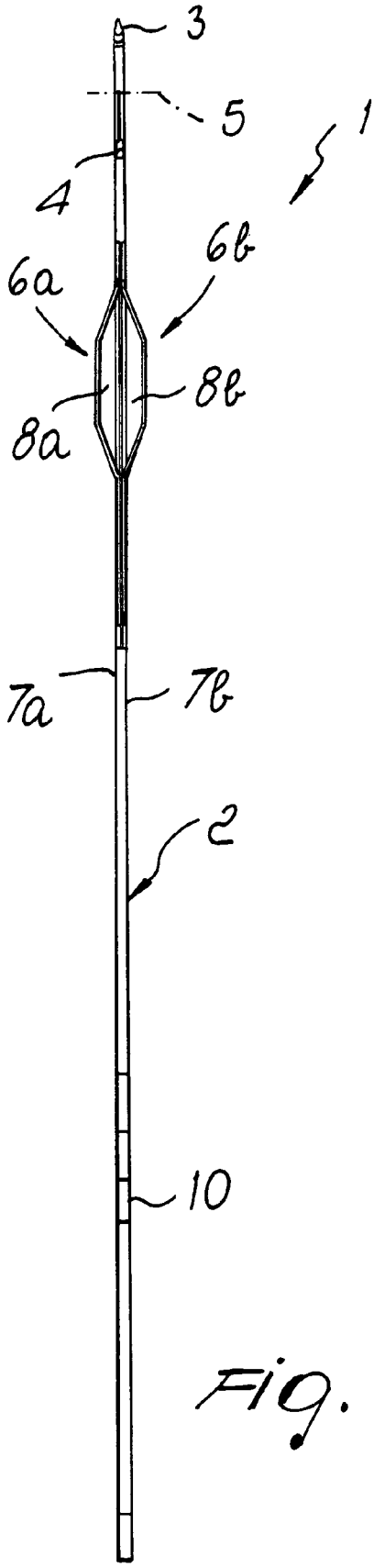
FIG. 2 is a front elevation view of the needle according to the invention.
Figure 3:
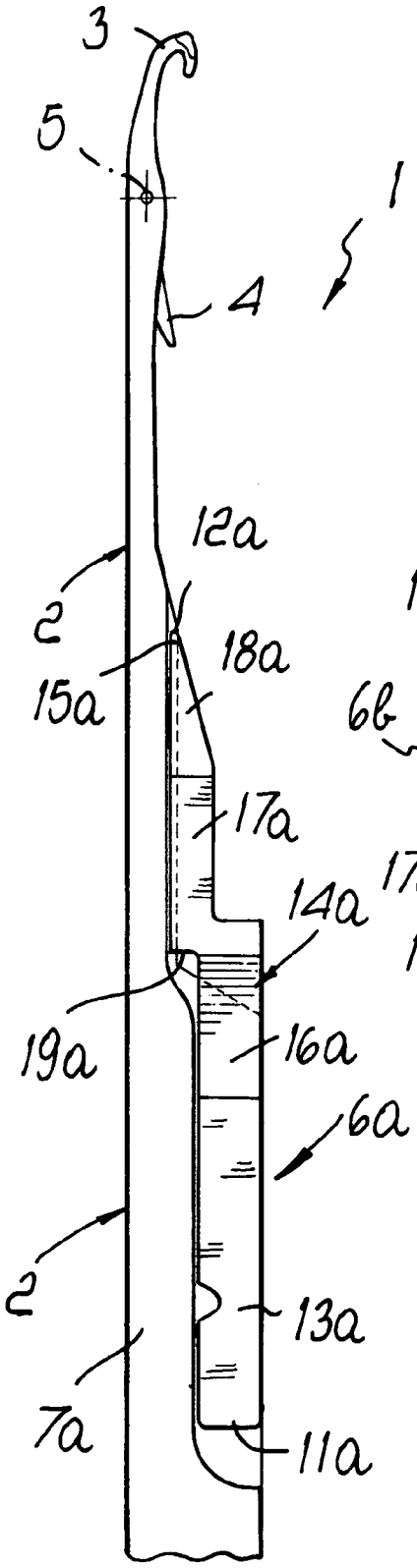
FIG. 3 is an enlarged-scale view of a detail of FIG. 1.
Figure 4:
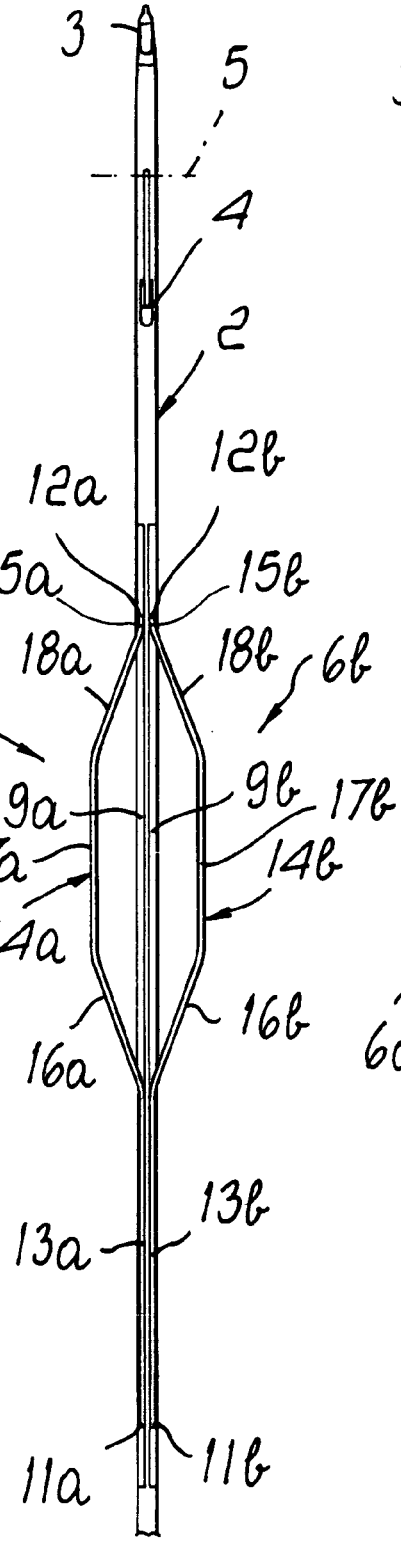
FIG. 4 is an enlarged-scale view of a detail of FIG. 2.

With particular reference to FIGS. 1 to 5, the needle according to the invention, generally designated by the reference numeral 1, comprises a shank 2, a head 3 and a latch 4.

The head 3 is arranged at a longitudinal end, or upper end, of the shank 2 and is shaped like a hook which is open toward the front face of the shank 2, in a manner similar to known types of needle.

The latch 4 is pivoted to the shank 2 proximate to the head 3 about a pivoting axis 5 which is substantially perpendicular to the longitudinal axis of the shank 2, and can rotate about the axis 5 to open or close the head 3, as in known types of needles.

The needle according to the invention comprises at least one lamina 6*a*, 6*b*, which is elastically flexible and is associated with the shank 2 and forms, on the two opposite sides 7*a*, 7*b* of the shank 2, below the latch 4, two receptacles 8*a*, 8*b*, one for each side 7*a*, 7*b* of the shank 2, in each of which it is possible to insert the head of an adjacent needle 1*a* in order to transfer the loop of knitting 40, carried by the shank 2 and arranged at the receptacles 8*a*, 8*b*, from the needle 1 to the adjacent needle 1*a*, as will become better apparent hereinafter.

Preferably, there are two elastically flexible laminas 6*a*, 6*b*, each of which is connected to a side 7*a*, 7*b* of the shank 2, and each one of these two laminas 6*a*, 6*b* forms a receptacle 8*a*, 8*b* for the adjacent needle 1*a*.

Each one of the laminas 6*a*, 6*b* is shaped so as to separate, with one of its portions, from the corresponding side 7*a*, 7*b* of the shank 2, so as to form the receptacle 8*a*, 8*b*, and can flex elastically toward the corresponding side the shank 2 in contrast with its elastic reaction.

Figure 5:
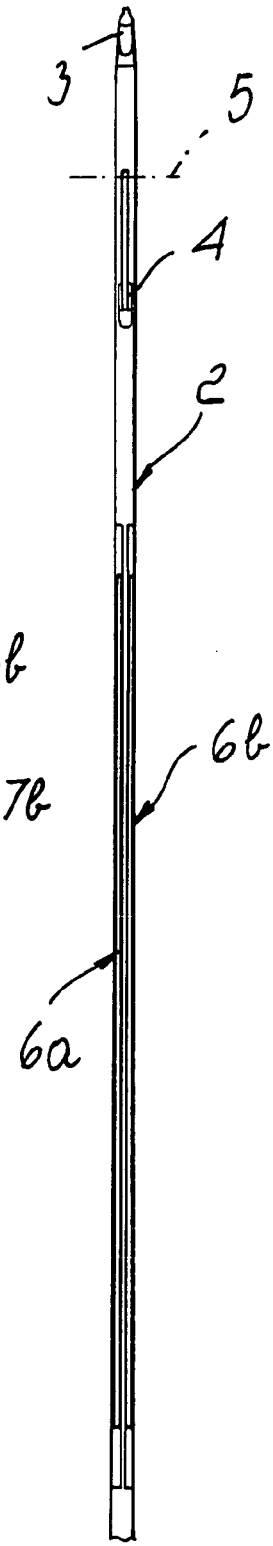
FIG. 5 is a view of the same detail of FIG. 4, with the at least one lamina compressed elastically against the shank.

Preferably, each side 7*a*, 7*b* of the shank 2 has, at the corresponding lamina 6*a*, 6*b*, a seat 9*a*, 9*b*, which is adapted to accommodate, substantially completely, the corresponding lamina 6*a*, 6*b* when it is pushed toward the shank 2 in contrast with its elastic reaction, as illustrated in particular in FIG. 5.

The shank 2 has, along its extension, on its front face or side toward which the head 3 opens, and proximate to its longitudinal end or lower end, which lies opposite with respect to the head 3, at least one heel 10, which protrudes at the front and can engage in a per se known manner the actuation cams of the needles provided in the hosiery knitting machine or the like on which the needle 1 is to be mounted.

The receptacle 8*a*, 8*b* formed by each one of the laminas 6*a*, 6*b* is open both toward the upper end of the shank 2 and toward the lower end, so as to allow the adjacent needle 1*a* to enter the receptacle 8*a*, 8*b* and exit from said receptacle 8*a*, 8*b*.

Each one of the laminas 6*a*, 6*b* is fixed, proximate to its lower end 11*a*, 11*b*, to the shank 2 and rests with its upper end 12*a*, 12*b* against the corresponding side 7*a*, 7*b* of the shank 2.

Each lamina 6*a*, 6*b* is shaped so as to have, if no forces are applied thereto, a lower region 13*a*, 13*b*, which adheres to the corresponding side 7*a*, 7*b* of the shank 2; an intermediate region 14*a*, 14*b*, which is spaced from the corresponding side 7*a*, 7*b* of the shank 2 in order to define the receptacle 8*a*, 8*b*; and an upper region 15*a*, 15*b*, which ends with the upper end 12*a*, 12*b* or which, as in the illustrated embodiment, is limited to said upper end 12*a*, 12*b* which rests against the corresponding side 7*a*, 7*b* of the shank 2.

Preferably, the intermediate region 14*a*, 14*b* of the lamina 6*a*, 6*b* is formed, starting from its lower end, by a first portion 16*a*, 16*b*, which is folded away from the corresponding side 7*a*, 7*b* of the shank 2; by a second portion 17*a*, 17*b*, which is substantially parallel to the corresponding side 7*a*, 7*b* of the shank 2; and a third portion 18*a*, 18*b*, which is folded toward the corresponding side 7*a*, 7*b* of the shank 2.

Moreover, each lamina 6*a*, 6*b* has, in its region which forms the receptacle 8*a*, 8*b*, an upper portion, which is offset toward the rear side of the shank 2 with respect to the underlying lower portion, so as to form a lower opening 19*a*, 19*b* for accessing the receptacle 8*a*, 8*b*. In the illustrated embodiment, said lower opening 19*a*, 19*b* is formed substantially at the connection between the first portion 16*a*, 16*b* and the second portion 17*a*, 17*b* of the intermediate region 14*a*, 14*b* of each lamina 6*a*, 6*b*.

Conveniently, the front face of the third portion 18*a*, 18*b* of the intermediate region 14*a*, 14*b* of each lamina 6*a*, 6*b* is shaped like an inclined plane and gradually approaches the front face of the shank 2 toward the upper end of said shank 2, connecting thereto at the upper region 15*a*, 15*b* of each lamina 6*a*, 6*b*.

In each lamina 6*a*, 6*b*, the lower opening 19*a*, 19*b* is preferably substantially aligned with the region where the upper region 15*a*, 15*b* of the lamina 6*a*, 6*b* rests against the corresponding side 7*a*, 7*b* of the shank 2 along a direction which is parallel to the longitudinal axis of the shank 2.

By equipping a hosiery knitting machine or the like with needles according to the invention, and by providing for them an actuation as described hereinafter, it is possible to transfer directly stitches 40 from one needle 1 to an adjacent needle 1*a* arranged laterally, on either side of the needle 1, without requiring additional elements which take the stitch or loop 40. For the sake of greater clarity, the needle that is adjacent to the one being considered has been designated by the reference numeral 1*a*, but it can be constituted by a needle 1 according to the invention.

The description of the execution of the transfer of a loop of knitting 40 from a needle 1 to an adjacent needle 1*a* is given, for the sake of greater clarity, with reference to a circular hosiery knitting machine or the like, assuming that the needles between which the loop of knitting 40 is transferred are in the needle cylinder of the machine, without altering the fact that the needle according to the invention can also be used in the dial of circular machines with a cylinder and dial or, more generally, both in rectilinear and circular single-bed or two-bed machines.

In order to transfer the loop of knitting 40 from a needle 1 to an adjacent needle 1*a*, the needle 1, after forming the loop of knitting 40 and releasing the previously formed loop of knitting, is transferred, by means of the actuation cams of the needles with which its heel 10 engages, so as to protrude partially above the knitting forming plane 21, which is formed by the sinkers 22, which retain the loops of knitting 40 that have just been formed. The extent of the lifting of the needle 1, which must transfer the loop of knitting and is termed hereinafter "transferring needle", is such as to place the intermediate region 14*a*, 14*b* of the laminas 6*a*, 6*b* at the knitting forming plane 21 and extract the intermediate region 14*a*, 14*b* completely from the region occupied by the so-called bars which delimit laterally the axial slots of the lateral surface of the needle cylinder in which the needles slide. In FIGS. 8*a*, 8*b* to 10*a*, 10*b*, the plane of the upper end of the bars has been designated by the reference numeral 23. In this manner, the laminas 6*a*, 6*b*, previously pressed against the shank 2 of the transferring needle 1 by the presence of the bars, move away by elastic reaction from the shank 2 with their intermediate region 14*a*, 14*b*, forming the receptacles 8*a*, 8*b* at which the loop 40 is positioned.

Figures 8A, 8B:
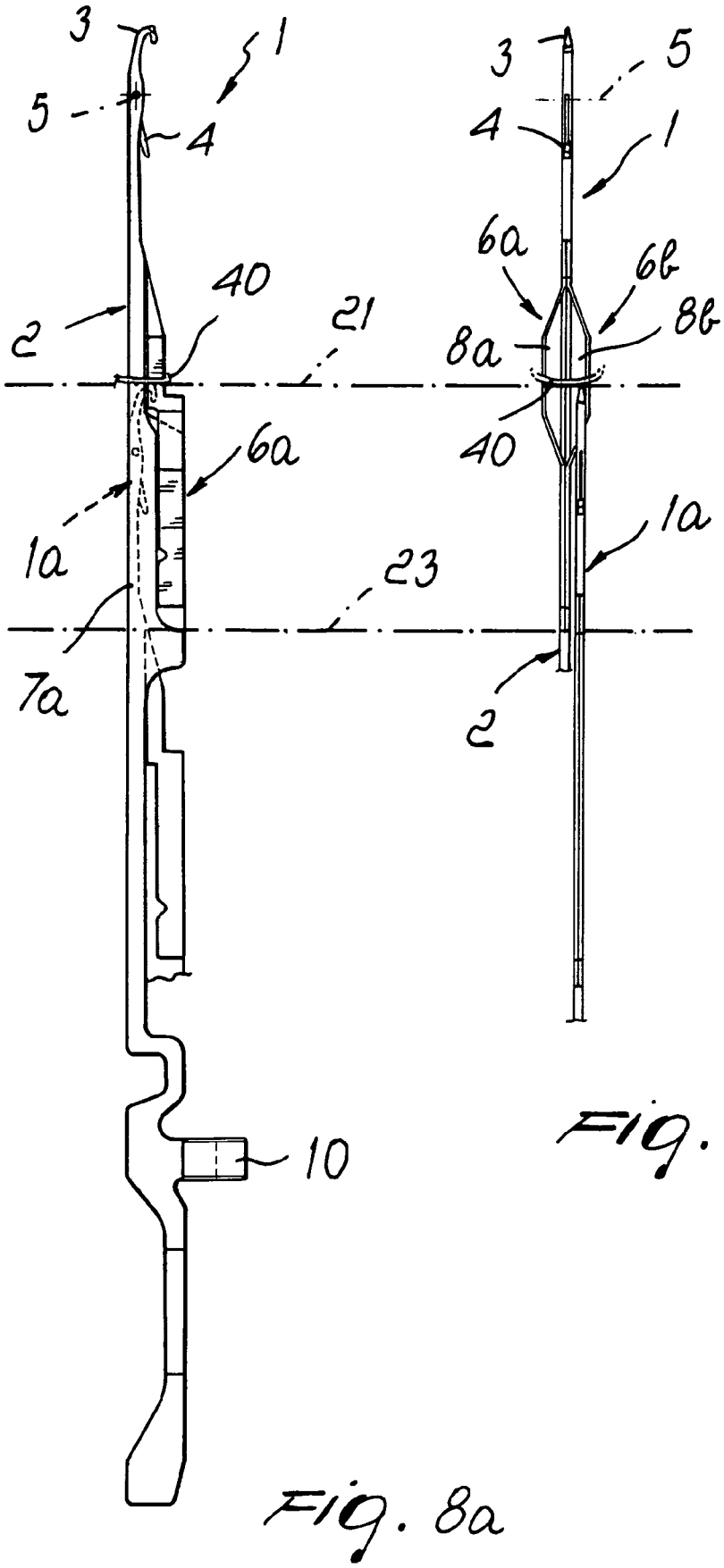
Figures 9A, 9B:
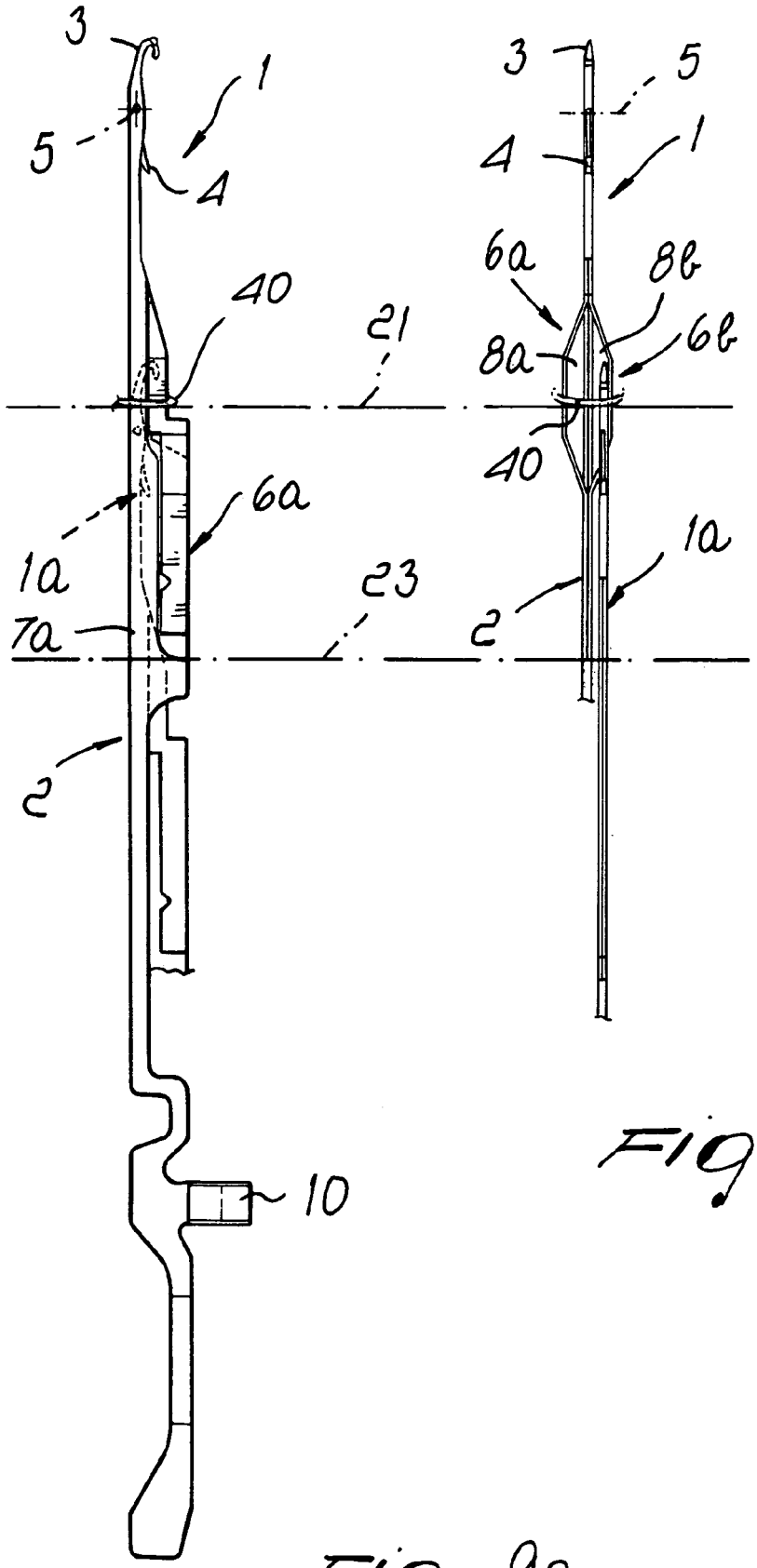

At this point, the adjacent needle 1*a*, onto which the loop of knitting 40 is to be transferred, and which is termed hereinafter "receiving needle", is moved upwardly with respect to the transferring needle 1. It should be noted that the receiving needle 1*a* is aligned with its head below the lower opening 19*a* or 19*b* of the receptacle 8*a* or 8*b*, and its upward movement produces the insertion of its beak within the receptacle 8*a* or 8*b* through the lower opening 19*a* or 19*b*. In the case shown in FIGS. 8*a*, 8*b* to 10*a*, 10*b*, the receiving needle 1*a* is constituted by the needle which, in the front views, lies to the right of the transferring needle 1 and therefore enters the receptacle 8*b*, passing through the lower opening 19*b*, as shown in FIGS. 8*a*, 8*b*.

Then, after completing the lifting of the receiving needle 1*a* so that its head lies above the knitting forming plane 21 and therefore above the loop 40 to be engaged (FIGS. 9*a*, 9*b*), the transferring needle 1 is lowered while the receiving needle 1*a* is kept motionless, preferably in a position which corresponds to the tuck-stitch position.

Figure 10B:
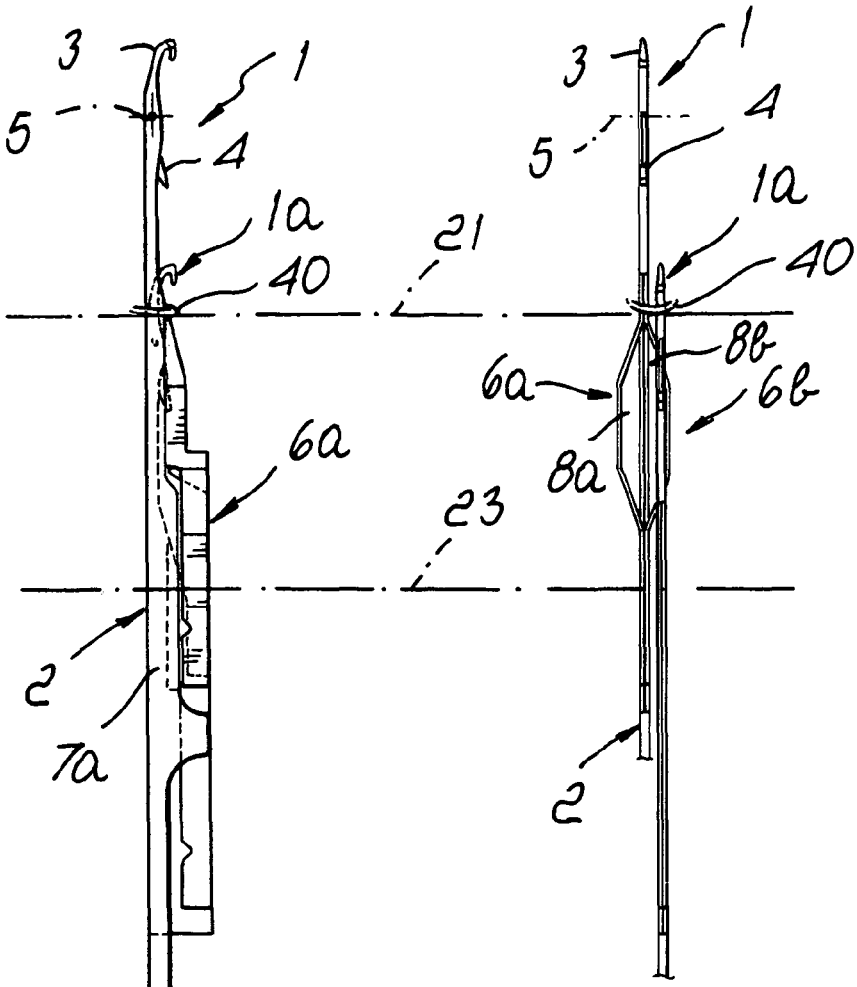
Figure 10A:
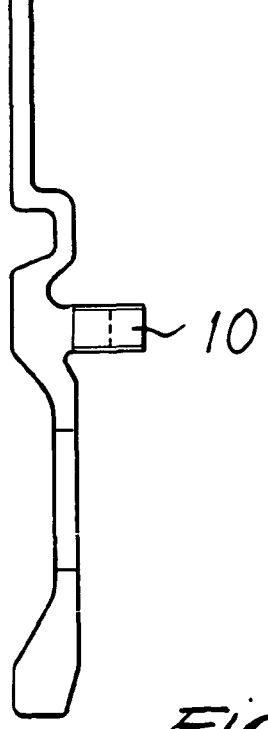

The descent of the transferring needle 1 causes the receiving needle 1*a* to exit with its head upwardly from the receptacle 8*b*, passing with its head between the upper end 12*b* of the lamina 6*b* and the shank 2 of the needle 1. Moreover, the descent of the needle 1 causes the loop of knitting 40, arranged around the laminas 6*a*, 6*b*, to slide along the inclined-plane part of the portion 18*b*, displacing it toward the shank 2 and bringing it into the head of the receiving needle 1*a*, as shown in FIGS. 10*a*, 10*b*.

When, during its descent, the transferring needle 1 with its latch has moved beyond the loop of knitting 40, which is in the head of the receiving needle 1*a* and produces the at least partial closure of the head 3 of the transferring needle 1 by the latch 4, the two needles 1 and 1*a* can be lowered together below the knitting formation plane 21.

In order to transfer the loop of knitting 40 not to the adjacent needle located to the right of the needle 1 but to the adjacent needle located to the left, it is sufficient to actuate said needle located to the left as described above with reference to the receiving needle 1*a*.

Of course, if the needles according to the invention are used in a dial of a cylinder-and-dial machine, the needles are moved radially outwardly instead of being raised and radially inwardly instead of being lowered.

The adaptation of the movements to be imparted to the needles according to the invention with reference to the machine on which they are mounted can be derived in any case straightforwardly on the basis of the explanation given above with reference to a single-bed circular machine.

It should be noted that during the transfer of the loop of knitting 40 from the transferring needle 1 to the receiving needle 1*a*, the latter is never raised or rather moved beyond the tuck-stitch position. For this reason, the laminas 6*a*, 6*b* optionally present on said needle 1*a* are unable to move away with their intermediate region 14*a*, 14*b* from the shank of the needle, being retained against it by the side walls of the axial slot of the needle cylinder or other needle supporting element in which it is contained.

The particular structure of the needle according to the invention with elastically flexible laminas which can move elastically toward the shank of the needle allows to provide the needle according to the invention with a reduced thickness, such as to allow its use in fine-gauge machines (more than 18 n.p.i.).

It should be noted that the needle according to the invention can be used advantageously also on two-bed machines to transfer a stitch from one bed to the other also with a transfer from a needle of one bed to an adjacent needle of the same bed without requiring relative movements of the beds and thus avoiding the problems of precision and complexity of execution that these movements involve.

Moreover, the use of needles according to the invention with the possibility to transfer the stitches on either side of the needles on machines which can be actuated with a reciprocating motion allows to produce items of knitting with knitted regions of any shape with added and cast-off stitches, increasing their quality and their degree of finish.

In practice it has been found that the needle according to the invention fully achieves the intended aim, since it allows direct transfer of the stitch from the needle itself to one of the two adjacent needles, i.e., in either direction.

Moreover, the needle according to the invention can have such a low thickness that it can be used in fine-gauge machines.

The needle thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

What is claimed is:

1. A needle for transferring stitches therefrom to adjacent needles for hosiery knitting machines, comprising a shank, a head arranged at a longitudinal end, or upper end, of said shank, and a latch which is pivoted to said shank proximate to said head, about a pivoting axis which is substantially perpendicular to the longitudinal axis of said shank and can rotate about said pivoting axis in order to open or close said head, further comprising at least one elastically flexible lamina which is associated with said shank and forms, on the two opposite sides of said shank, below said latch, two receptacles, one for each side of said shank, in each of which it is possible to insert the head of an adjacent needle in order to transfer the loop of knitting, carried by said shank and arranged at said receptacles, from the needle to said adjacent needle.

2. The needle according to claim 1, further comprising two elastically flexible laminas, each of which is connected to one side of said shank and forms a receptacle for said adjacent needle.

3. The needle according to claim 2, wherein said laminas are elastically flexible toward the corresponding side of the shank in contrast with their elastic reaction.

4. The needle according to claim 3, wherein each side of the shank has, at the corresponding elastically flexible lamina, a seat which is adapted to accommodate the respective lamina pushed toward said shank in contrast with the elastic reaction of said elastically flexible lamina.

5. The needle according to claim 1, wherein said shank has, along its extension, on its front face, arranged between said two sides, and proximate to its longitudinal end or lower end, which lies opposite with respect to the head, at least one heel which protrudes at the front and can engage needle actuation cams of the hosiery knitting machine.

6. The needle according to claim 2, wherein the receptacle formed by each one of said laminas is open both toward the longitudinal end of said shank with said head and toward the opposite longitudinal end.

7. The needle according to claim 2, wherein each one of said laminas is fixed by means of its lower end to said shank and rests with its upper end against the side of said shank.

8. The needle according to claim 2, wherein each one of said laminas, if no forces are applied thereto, has a lower region which lies in contact with the corresponding side of said shank, an intermediate region which is spaced from the corresponding side of said shank in order to form said receptacle, and an upper region which rests against the corresponding side of said shank.

9. The needle claim 8, wherein said intermediate region of the lamina has, starting from its lower end: a first portion, which is folded away from the corresponding side of the shank; a second portion, which is substantially parallel to the corresponding side of the shank; and a third portion, which is folded toward the corresponding side of the shank.

10. The needle according to claim 2, wherein each one of said laminas has, in its region which forms said receptacle, an upper portion which is offset toward the rear side of the shank with respect to the underlying lower portion in order to form a lower opening for accessing said receptacle.

11. The needle according to claim 10, wherein said lower access opening is formed proximate to the connection between said first portion and said second portion of said intermediate region of each lamina.

12. The needle according to claim 9, wherein the front face of said third portion of the intermediate region of each lamina is shaped like an inclined plane and gradually approaches the front face of said shank in the direction of the upper end of said shank and connects thereto at said upper region of each lamina.

13. The needle according to claim 10, wherein, in each lamina, said lower access opening is substantially aligned with the region where said upper region of the lamina rests against the corresponding side of the shank in a direction which is parallel to the longitudinal axis of the shank.

14. A method for transferring a stitch from a needle to an adjacent needle in hosiery knitting machines equipped with needles comprising a shank, a head arranged at a longitudinal end, or upper end, of said shank, and a latch which is pivoted to said shank proximate to said head, about a pivoting axis which is substantially perpendicular to the longitudinal axis of said shank and can rotate about said pivoting axis in order to open or close said head, further comprising at least one elastically flexible lamina which is associated with said shank and forms, on the two opposite sides of said shank, below said latch, two receptacles, one for each side of said shank, in each of which it is possible to insert the head of an adjacent needle in order to transfer the loop of knitting, carried by said shank and arranged at said receptacles, from the needle to said adjacent needle, the method comprising the following steps of:

moving the needle, provided with said at least one lamina, on which the loop of knitting to be transferred is arranged, or transferring needle, with respect to the loop of knitting formed by said needle until the loop of knitting is arranged around said receptacles located proximate to the knitting formation plane;

retaining the loop of knitting around said receptacles;

moving a needle designed to receive said loop of knitting, or receiving needle, arranged laterally to the transferring needle, toward the head of the transferring needle and along a direction which has at least one component which is parallel to the longitudinal axis of the transferring needle, inserting it with its head in the receptacle of said two receptacles that is located on the side of said transferring needle that is directed toward said receiving needle until it moves above and beyond said loop of knitting;

moving said transferring needle with respect to said receiving needle and to said loop of knitting along said direction until the head of said receiving needle protrudes upwardly from said receptacle and so as to move said loop of knitting above said receptacle;

moving said transferring needle further along said direction until it moves, with its latch, beyond the loop of knitting;

moving both needles along said direction with respect to the loop of knitting until the loop of knitting disengages from said transferring needle.

* * * * *